US010480184B2

(12) United States Patent
Berneth et al.

(10) Patent No.: US 10,480,184 B2
(45) Date of Patent: Nov. 19, 2019

(54) SOUND-PERMEABLE LINING FOR ACOUSTIC PLASTERBOARDS

(71) Applicants: KNAUF GIPS KG, Iphofen (DE); 3D COATINGS GMBH & CO. KG, Reichenberg (DE)

(72) Inventors: Claus-Peter Berneth, Marktbreit (DE); Matthias Schaefer, Buetthard (DE); Gottfried Philipp, Kist (DE); Andreas Marquardt, Zellingen (DE)

(73) Assignee: Knauf Gips KG, Iphofen (DE)

( * ) Notice: Subject to any disclaimer, the term of this patent is extended or adjusted under 35 U.S.C. 154(b) by 0 days.

(21) Appl. No.: 15/311,209

(22) PCT Filed: Aug. 22, 2014

(86) PCT No.: PCT/EP2014/002596
§ 371 (c)(1),
(2) Date: Nov. 15, 2016

(87) PCT Pub. No.: WO2015/172799
PCT Pub. Date: Nov. 19, 2015

(65) Prior Publication Data

US 2017/0081843 A1 Mar. 23, 2017

(30) Foreign Application Priority Data

May 15, 2014 (WO) ..... PCT/EP2014/001312

(51) Int. Cl.
*E04B 1/84* (2006.01)
*E04F 13/08* (2006.01)
(Continued)

(52) U.S. Cl.
CPC ..... *E04B 1/8409* (2013.01); *E04B 1/86* (2013.01); *E04B 9/0464* (2013.01);
(Continued)

(58) Field of Classification Search
CPC ..... E04B 1/8409; E04B 1/86; E04B 9/0464; G10K 11/168; G10K 11/16
(Continued)

(56) References Cited

U.S. PATENT DOCUMENTS 3,404,748 A * 10/1968 Bjorksten ..... B31F 1/2886 156/210
3,621,934 A 11/1971 Thrasher et al.
(Continued)

FOREIGN PATENT DOCUMENTS

CA 2557703 A1 * 10/2005 ..... E04B 9/001
CA 2962552 A1 * 3/2016 ..... E04C 2/50
(Continued)

*Primary Examiner* — Forrest M Phillips
(74) *Attorney, Agent, or Firm* — Robert Lelkes

(57) ABSTRACT

Sound-permeable lining (1) for covering perforations (21) shaped in an acoustic plasterboard (2). The sound-permeable lining (1) comprises a first ply (12) of a fleece material and attached thereto a second ply (14) which is arranged in between of the first ply (12) and the acoustic plasterboard (2) to which the sound-permeable lining (1) is to be applied. The second ply (14) being of a foil material having a second opacity $O_2$ and a plurality of through-holes (141) formed therein. The first ply (12) has a first opacity $O_1$ so that the through-holes (141) formed in the second ply (14) are invisible through the first ply (12) and so that the applied sound-permeable lining (1) has an overall opacity $O_{12}$ to allow for optically covering the perforations (21) shaped in the acoustic plasterboard (2) and an overall air flow resistivity $R_{s12}$ to allow for the penetration of air so that sound can propagate via the sound-permeable lining (1).

22 Claims, 3 Drawing Sheets

(51) Int. Cl.
*E04B 1/86* (2006.01)
*E04B 9/04* (2006.01)
*G10K 11/16* (2006.01)
*G10K 11/168* (2006.01)

(52) U.S. Cl.
CPC ..... *E04F 13/0867* (2013.01); *G10K 11/16* (2013.01); *G10K 11/168* (2013.01)

(58) Field of Classification Search
USPC ..... 181/291, 284
See application file for complete search history.

(56) References Cited

U.S. PATENT DOCUMENTS 4,084,367 A * 4/1978 Saylor ..... B29D 24/005 428/113
4,254,171 A 3/1981 Beggs et al.
4,347,912 A 9/1982 Flocke et al.
4,487,794 A * 12/1984 Brown ..... B32B 15/14 156/253
5,554,830 A * 9/1996 Muller ..... B32B 7/02 181/290
6,675,551 B1 * 1/2004 Fuchs ..... E04B 1/86 52/144
8,684,134 B2 * 4/2014 Dugan ..... E04B 1/8409 181/290
8,708,097 B2 * 4/2014 Borroni ..... B32B 3/266 181/286
9,649,831 B2 * 5/2017 Gosling ..... E04B 2/02
2006/0289232 A1 * 12/2006 Muller ..... G10K 11/168 181/292
2007/0102237 A1 * 5/2007 Baig ..... E04B 9/045 181/290
2007/0186493 A1 * 8/2007 Baig ..... B28B 11/12 52/144
2011/0139542 A1 * 6/2011 Borroni ..... B32B 3/266 181/290
2011/0147119 A1 * 6/2011 Cao ..... B32B 37/1284 181/292

FOREIGN PATENT DOCUMENTS

DE 1609413 A1 1/1970
DE 3334331 A1 4/1985
DE 8705270 U1 7/1987
EP 246464 A1 11/1987
WO WO 2012004220 A2 * 1/2012 ..... E04B 1/86
WO 2013159240 A1 10/2013

* cited by examiner

SOUND-PERMEABLE LINING FOR ACOUSTIC PLASTERBOARDS

The present invention relates to a sound-permeable lining according to the preamble of the independent claim which is to be arranged at acoustic plasterboards for covering the perforations shaped therein.

Sound occurring in a room, e.g. impact noise sound or reverberation sound, can be attenuated by destroying the energy of the propagating sound waves. Attenuation is achieved by interior dry-wall constructions comprising acoustic plasterboards. Acoustic plasterboards have a plurality of perforations shaped therein through which air can pass. The passage of air provides a medium for the propagating sound which is attenuated in the space behind the acoustic plasterboard, e.g. in between of the acoustic plasterboard and the raw ceiling. Typically, such a perforation has an opening diameter in the range of 2 mm to 25 mm. The perforations can be shaped round or square and might be arranged in a visually appealing manner, i.e. a straight-line perforation, a staggered perforation or a scattered perforation.

Such acoustic plasterboards are typically made from gypsum plaster which may comprise fibers therein. However the plaster may be of another material comprising cement. Dependent from the type of ceiling, these acoustic plasterboards are usually available in the dimensions 600×600 mm (coffer ceiling) or as large format in 1200×2000 mm (completely closed ceiling). The acoustic plasterboards can be arranged with visible joints in between. Alternatively, these joints can be covered by a filler material. Like the perforations, the joints can be intentionally visible for being utilised as "design element". However, common acoustic plasterboard designs are often seen as limiting the overall design possibilities. Under creative aspects, closed surfaces without visually perceptible structures are preferred.

For providing such a closed surface, it is known from prior art techniques to apply an acoustic plaster to acoustic plasterboards. The acoustic plaster covers the perforations shaped in the acoustic plasterboard while being permeable for air to allow for the propagation of sound through it. The acoustic plaster is applied by attaching a fleece layer to the acoustic plasterboard and spraying the acoustic plaster onto the fleece layer. The acoustic plaster is applied in several spraying cycles until the visually closed surface is achieved. The number of spraying cycles is kept low to maintain a good permeability for air which allows for sound to propagate via the acoustic plaster.

The application of the fleece layer is difficult, in particular at the construction site, so that the resulting finished surfaces are often of poor visual quality. The processing of the acoustic plaster is disadvantageous, as the thin layered structure of the plaster layer which is required for sufficient acoustic properties is often not achieved in a consistent manner. As a result, the sound propagation and therewith the acoustical properties vary and the acoustic requirements are often not met. Another disadvantage relates to the acoustic plaster itself which has a relatively rough and coarse structure so as to be less preferred under design aspects. Furthermore, the application of the acoustic plaster in several spray-cycles is extremely time-consuming because of the applied layer is very thin in each spraying cycle.

Therefore, it is an object of the invention to suggest a sound-permeable lining to be applied to an acoustic plasterboard capable of hiding the perforations shaped in the acoustic plasterboard which overcomes or at least greatly reduces the disadvantages known from the prior art, that is to say a sound-permeable lining that is to be arranged for covering perforations shaped in an acoustic plasterboard which performs consistent sound qualities.

This object is achieved by the sound-permeable lining as it is characterized by the features of the independent claim. Advantageous embodiments become evident from the features of the dependent claims.

In particular a sound-permeable lining for covering perforations shaped in an acoustic plasterboard. The sound-permeable lining comprises a first ply of a fleece material having an inner structure so that the first ply has a first air flow resistivity $R_{S1}$ which allows for the penetration of air so that sound can propagate via the first ply and attached thereto a second ply which is arranged in between of the first ply and the acoustic plasterboard to which the sound-permeable lining is to be applied. The second ply is of a foil material having a second opacity $O_2$ and a plurality of through-holes formed therein which are of a size and shape so that the second ply has a second air flow resistivity $R_{S2}$ which allows for the penetration of air so that sound can propagate via the second ply. The first ply has a first opacity $O_1$ so that the through-holes formed in the second ply are invisible through the first ply and so that the applied sound-permeable lining has an overall opacity $O_{12}$ to allow for optically covering the perforations shaped in the acoustic plasterboard and an overall air flow resistivity $R_{S12}$ to allow for the penetration of air so that sound can propagate via the sound-permeable lining.

Thus, the invention provides a sound-permeable lining which can be uniformly applied and which has an overall opacity $O_{12}$ to hide the perforations shaped in acoustic plasterboards while it has an overall air flow resistivity $R_{S12}$ which allows for good penetration of air as a medium for sound waves over the entire area of the lining.

The overall opacity $O_{12}$ can be determined as defined in the standard DIN 53164 (comparable to ISO 2471) in which the opacity is defined in % as $O=R_0/R_\infty$. $R_0$ is the reflection of the sample which is the ratio of the light reflected at the sample to light reflected at a standard white body (a white standard is given in DIN 5033 as tablet of bariumsulfat powder). $R_\infty$ is the reflection of an opaque sample which can be provided as stack of samples thick enough to be opaque, i.e. such that increasing the thickness of the stack by doubling the number of samples results in no change in the measured reflection. In general, the overall opacity $O_{12}$ is determined by the first opacity $O_1$ and the second opacity $O_2$, wherein the first opacity $O_1$ is chosen to hide the perforations in the acoustic plasterboard and the second opacity $O_2$ is chosen to hide the perforations in the second ply.

The overall air flow resistivity $R_{S12}$ determines the acoustical permeability of the sound permeable lining or in other words the acoustical characteristic thereof. The standard DIN EN 29053 "Materialien für akustische Anwendungen-Bestimmung des Strömungswiderstandes" defines measurements (direct air current, alternating air current) to determine the air flow resistivity $R_S$ which is the ratio of the pressure difference [Pa] at both sides of the sample to the air volume current [$m^3/s$] penetrating the sample. The materials are described herein by the specific air flow resistivity [Pam] which is the air flow resistivity per surface area in $m^2$.

According to a preferred aspect of the invention, the overall air flow resistivity $R_{S12}$ is less than 300 Pas/m and the overall opacity $O_{12}$ is in the range of 92% to 98%. The overall opacity $O_{12}$ for a combination of a standard fleece (spunbond fleece made from polyester having an areal weight of 80 g/m$^2$) and a standard foil (a polyester foil of a thickness of 12 μm and being metallized at one side) is 95%.

Advantageously, the first ply has the first opacity $O_1$ in between of 50% to 75% to allow for covering the through-holes in the second ply of a size smaller than 500 μm in diameter when the lining is applied to an acoustic ceiling.

It has shown to be specifically advantageous if the fleece material has synthetic fibres, natural fibres and mixtures of synthetic fibres and natural fibres. Particularly advantageous are mixtures of polyethylene terephthalate fibres and cellulose fibres. The fibres can be fixed to form the fleece in different ways. The fibres can be fixed chemically by use of a binding substance which polymerizes or hardens when drying. The fibres can be fixed thermally by locally applying pressure and heat due to a spiked roller so that the fibres melt to each other. A third method fixes the fibres mechanically by milling, pressing and/or intermeshing.

It has shown to be advantageous for the application of the lining as well as for a good sound transmission that the fleece material has an areal density in between of 60 g/m$^2$ and 130 g/m$^2$. Areal densities below 80 g/m$^2$ are preferred since they keep the overall weight of the sound-permeable lining low for a firm fix of the lining at the acoustic ceiling.

To provide a range of design options, the first ply comprises in a preferred aspect color pigments which can be applied in an amount of 25 g/m$^2$ to 35 g/m$^2$.

According to a particularly advantageous aspect, the second ply comprises a light reflective surface at the side to be attached to the first ply to allow for optically reflecting the first ply thereon. In a particular example, the second ply is a plastic foil to which an aluminum layer is applied by evaporation deposition. The reflective layer increases the visual masking effect of the first ply since the first ply which optically covers the through-holes is reflected at the second ply.

Advantageously, the foil material is of a thickness of less than 50 μm. The foil diameter of less than 12 μm has good handling properties.

Particularly advantageous acoustical properties can be achieved by that the through-holes are arranged in an areal density of more than 15 through-holes/cm$^2$, in particular more than 50 through-holes/cm$^2$, and are of a size in diameter smaller than 500 μm so that the integrated cross-sectional area of the through-holes per area of foil is of 0.05 to 0.20 cm$^2$/cm$^2$.

Preferably, the first ply is attached to the second ply by a plurality of glue dots. Each glue dot is arranged at a location different from locations of the second ply at which such a through-hole of the plurality of through-holes is formed. This allows to prevent the clogging of the through-holes and hence a decrease in acoustical performance. In a particular example, each glue dot is of a diameter of less than 700 μm and more preferably less than 300 μm.

Advantageously, each glue dot comprises a heat-activated adhesive material, in particular polyolefin, polyamides, polyesters or polyurethanes, or a pressure sensitive adhesive material, in particular rubbers or UV-acrylates.

Preferably, the sound-permeable lining further comprises a third ply which is arranged in between of the second ply and the acoustic plasterboard to which the sound-permeable lining is to be applied. The third ply is capable of forming a contact layer so as to increase the adhesive attachment of the sound-permeable lining applied to the acoustic plasterboard. The third ply is for example a fleece layer similar to the first ply and which allows for increasing the contact between the foil of the second ply and the acoustic plasterboard to which the sound-permeable lining is applied. The third ply can have an identical opacity and air flow resistivity as the first ply.

Another advantageous aspect of the invention relates to an acoustic plasterboard having attached thereto a sound-permeable lining as described hereinbefore. The sound-permeable lining being applied so that a single sound-permeable lining covers perforations shaped in different acoustic plasterboards.

Further advantageous aspects of the sound-permeable lining according to the invention become evident by the following detailed description of the specific embodiments with the aid of the drawings, in which.

Figure 1:
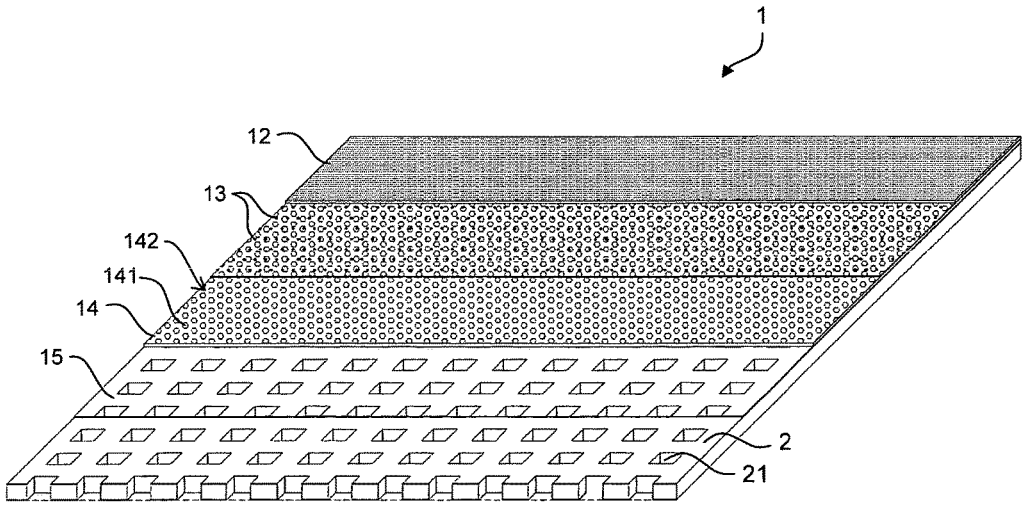
FIG. 1 is a perspective view of an applied sound-permeable lining according to a first embodiment of the invention.

FIG. 1 shows a perspective view of an applied sound-permeable lining 1 according to a first embodiment of the invention. The first embodiment does not comprise a third ply so that the second ply 14 is directly applied to the acoustic plasterboard 2 (e.g. a Knauf Cleaneo plasterboard). The illustrated portion of acoustic plasterboard 2 is representative for any acoustic ceiling dry-wall construction comprising a plurality of adjacently mounted acoustic plasterboards 2 having a plurality of perforations 21 shaped therein. In such dry-wall constructions, acoustic plasterboard 2 is mounted via profiles at a predetermined distance to a raw ceiling by use of a hanger (e.g. Knauf Nonius Hänger). The sound-permeable lining 1 is applied to the mounted acoustic plasterboards 2 in the same manner as a wall paper.

Sound-permeable lining 1 comprises a first ply 12 of a spun bonded polyester fleece material and plastic (i.e. polyester) foil as second ply 14. Plastic foil 14 comprises a reflective surface 142 comprising deposited Aluminum and has a plurality of through-holes 141 formed therein. Each through-hole 141 has a diameter of 500 μm. An adhesive layer 15 fixes plastic foil 14 to acoustic plaster board 2. The fleece 12 is attached to plastic foil 14 by a plurality of glue dots 13 in a printing step. Glue dots 13 are of a heat-activated material and have a diameter of 700 μm. In general, glue dots 13 are arranged at locations on plastic foil 14 different from locations at which a through-hole 141 is formed. The fleece 12 is of a material having an areal density of 80 g/m$^2$ and an opacity of 50%. The combination of the plastic foil 14 and the fleece 12 has an overall opacity $O_{12}$ of about 95%. Lining 1 has an overall air flow resistivity $R_{S12}$ of 300 Pas/m.

Figure 2:
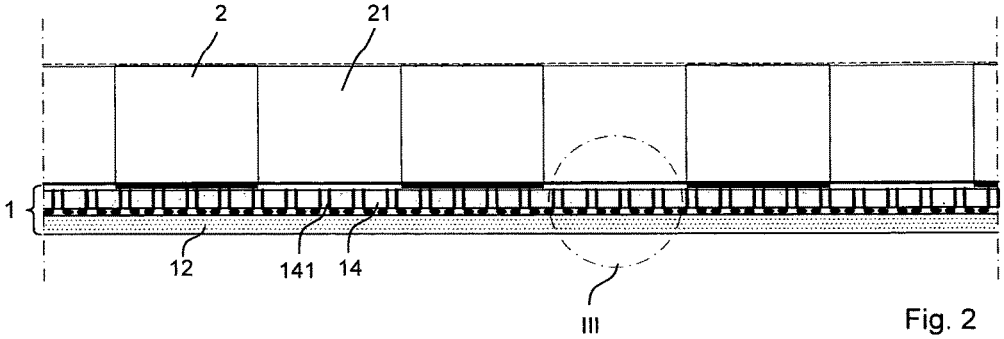
FIG. 2 is a side view of the sound-permeable lining in FIG. 1.
Figure 3:
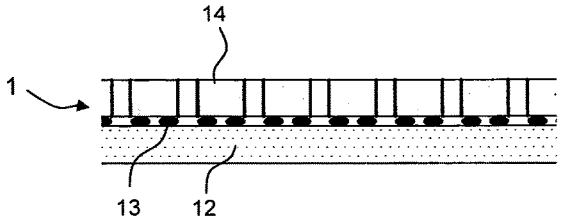
FIG. 3 is a detailed view of the sound-permeable lining in FIG. 2.

FIG. 2 and FIG. 3, which is an exaggerated view of FIG. 2, are side views onto the sound-permeable lining of FIG. 1. Sound-permeable lining 1 can be applied to the acoustic plasterboard 2 comparable to wallpaper. The overall opacity $O_{12}$ allows hiding the perforations 21 shaped in acoustic plasterboard 2 so that they can not be seen from below by a human in a room in which the ceiling is formed. The overall air flow resistivity $R_{S12}$ allows for good penetration of air as a medium for sound waves. In general, the sound absorption coefficient for a ceiling system made of acoustic plasterboard having applied thereto the sound-permeable lining have been determined to be in the range of $\alpha_w$=50 to 80 (DIN EN ISO 11654). Acoustic plasterboard 2 has perforations 21 shaped therein which form through openings 21 through which the air as medium for the propagation of sound can penetrate the acoustic plasterboard. Attached from below is sound-permeable lining 1 having (from bottom to top) a fleece 12, and a perforated plastic foil 14 which are fixed to each other by a plurality of glue dots 13. The perforation comprises a plurality of through-holes 141 formed therein which allow for air as a medium for sound to penetrate the plastic foil 1. In general these through-holes 141 can be formed by a needle roller which is rolled along the surface so that the needles penetrate the plastic foil 12. The diameter of through-holes 141 is preferably so that the overall area of through-holes 141 is 5% to 20% of the plastic foil 12. According to another example (not shown) the through holes can be arranged (formed) pairwise.

Figure 4:
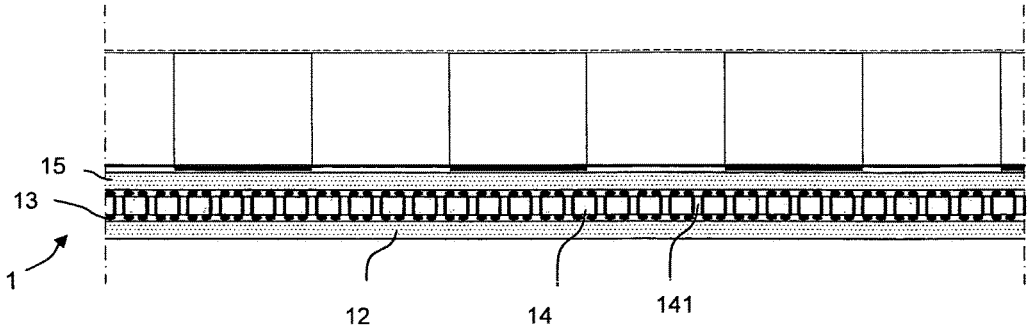
FIG. 4 is a side view of a sound-permeable lining according to a second embodiment of the invention.

FIG. 4 is a side view of a sound-permeable lining 1 according to a second embodiment of the invention according to which sound-permeable lining 1 further comprises a third ply 15. In the present example, the third ply is a further fleece 15 which can be fixed to acoustic plasterboard 2 and to which the perforated plastic foil 14 which forms the second ply is attached. The perforated plastic foil 14 is attached to the further fleece 15 by a further plurality of glue dots 13. Advantageously, the adhesive for fixing the third ply to the acoustic plasterboard can be applied over the entire upper surface of the further fleece 15.

The invention claimed is:

1. A sound-permeable lining (1) for covering perforations (21) shaped in an acoustic plasterboard (2), the sound-permeable lining (1) comprising a first ply (12) of a fleece material having an inner structure so that the first ply (12) has a first air flow resistivity $R_{S1}$ which allows for the penetration of air so that sound can propagate via the first ply (12) and attached thereto and a second ply (14) which is arranged in between of the first ply (12) and the acoustic plasterboard (2) to which the sound-permeable lining (1) is to be applied, the second ply (14) being of a foil material having a second opacity $O_2$ and a plurality of through-holes (141) formed therein which are of a size and shape so that the second ply (14) has a second air flow resistivity $R_{S2}$ which allows for the penetration of air so that sound can propagate via the second ply (14), wherein the first ply (12) has a first opacity $O_1$ so that the through-holes (141) formed in the second ply (14) are invisible through the first ply (12) and so that the applied sound-permeable lining (1) has an overall opacity $O_{12}$ to allow for optically covering the perforations (21) shaped in the acoustic plasterboard (2) and an overall air flow resistivity $R_{S12}$ to allow for the penetration of air so that sound can propagate via the sound-permeable lining (1) and the second ply (14) comprises a light reflective surface (142) at the side to be attached to the first ply (12) to allow for optically reflecting the first ply (2) thereon.

2. The sound-permeable lining (1) according claim 1, wherein the overall air flow resistivity $R_{S12}$ is less than 300 Pas/m and the overall opacity $O_{12}$ is in the range of 92% to 98%.

3. The sound-permeable lining (1) according to claim 1, wherein the first ply (12) has the first opacity $O_1$ in between of 50% to 75% to allow for covering the through-holes (141) in the second ply (14) of a size smaller than 500 μm in diameter.

4. The sound-permeable lining (1) according to claim 1, wherein the fleece material has synthetic fibres, natural fibres and mixtures of synthetic fibres and natural fibres.

5. The sound-permeable lining (1) according to claim 1, wherein the first ply (12) has an areal density in between of 60 g/m$^2$ and 130 g/m$^2$.

6. The sound-permeable lining (1) according to claim 1, wherein the first ply (12) comprises color pigments.

7. The sound-permeable lining (1) according to claim 1, wherein the second ply (14) is a plastic foil to which an aluminum layer is applied by evaporation deposition.

8. The sound-permeable lining (1) according to claim 1, wherein the second ply (14) is of a thickness less than 50 μm.

9. The sound-permeable lining (1) according to claim 1, wherein the through-holes (141) are arranged in an areal density of more than 15 through-holes/cm$^2$, and are of a size in diameter smaller than 500 μm so that the integrated cross-sectional area of the through-holes (141) per area of foil is of 0.05 to 0.20 cm$^2$/cm$^2$.

10. The sound-permeable lining (1) according to claim 1, wherein the first ply (12) is attached to the second ply (14) by a plurality of glue dots (13), each glue dot (13) being arranged at a location different from locations of the second ply (14) at which such a through-hole (141) of the plurality of through-holes (141) is formed.

11. The sound-permeable lining (1) according to claim 10, wherein each glue dot (13) is of a diameter of less than 700 μm.

12. The sound-permeable lining (1) according to claim 10, wherein each glue dot (13) comprises a heat-activated adhesive material or a pressure sensitive adhesive materials.

13. The sound-permeable lining (1) according to claim 1 further comprising a third ply (15) which is arranged in between of the second ply (14) and the acoustic plasterboard (2) to which the sound-permeable lining (1) is to be applied, the third ply (15) being capable of forming a contact layer so as to increase the adhesive attachment of the sound-permeable lining (1) applied to the acoustic plasterboard (2).

14. An acoustic plasterboard (2) having applied thereto a sound-permeable lining (1) according to claim 1, the sound-permeable lining (1) being applied so that a single sound-permeable lining (1) covers perforations shaped in different acoustic plasterboards (2).

15. The sound-permeable lining (1) according to claim 4, wherein the fleece material has mixtures of polyethylene terephthalate fibers and cellulose fibers.

16. The sound-permeable lining (1) according to claim 8, wherein the second ply (14) is of a thickness less than 12 μm.

17. The sound-permeable lining (1) according to claim 11, wherein each glue dot (13) is of a diameter of less than 300 μm.

18. The sound-permeable lining (1) according to claim 12, wherein the heat-activated adhesive material is selected from a polyolefin, polyamides, polyesters or polyurethanes.

19. The sound-permeable lining (1) according to claim 12, wherein the pressure sensitive adhesive material is selected from rubbers or UV-acrylates.

20. The sound-permeable lining according to claim 2, wherein the overall opacity $O_{12}$ is 95%.

21. The sound-permeable lining (1) according to claim 9, wherein the through-holes (141) are arranged in an areal density of more than 50 through-holes/cm$^2$.

22. A sound-permeable lining (1) for covering perforations (21) shaped in an acoustic plasterboard (2), the sound-permeable lining (1) comprising a first ply (12) of a fleece material having an inner structure so that the first ply (12) has a first air flow resistivity $R_{S1}$ which allows for the penetration of air so that sound can propagate via the first ply (12) and attached thereto and a second ply (14) which is arranged in between of the first ply (12) and the acoustic plasterboard (2) to which the sound-permeable lining (1) is to be applied, the second ply (14) being of a foil material having a second opacity $O_2$ and a plurality of through-holes (141) formed therein which are of a size and shape so that the second ply (14) has a second air flow resistivity $R_{S2}$ which allows for the penetration of air so that sound can propagate via the second ply (14), wherein the first ply (12) has a first opacity $O_1$ so that the through-holes (141) formed in the second ply (14) are invisible through the first ply (12) and so that the applied sound-permeable lining (1) has an overall opacity $O_{12}$ to allow for optically covering the perforations (21) shaped in the acoustic plasterboard (2) and an overall air flow resistivity $R_{S12}$ to allow for the penetration of air so that sound can propagate via the sound-permeable lining (1) and the second ply (14) is a plastic foil to which an aluminum layer is applied by evaporation deposition.

* * * * *